United States Patent [19]

Ho et al.

[11] Patent Number: 4,967,032

[45] Date of Patent: Oct. 30, 1990

[54] PROCESS FOR IMPROVING THERMAL STABILITY OF SYNTHETIC LUBES

[75] Inventors: Suzzy C. Ho, Plainsboro; Margaret M. Wu, Belle Mead, both of N.J.

[73] Assignee: Mobil Oil Corporation, Fairfax, Va.

[21] Appl. No.: 402,373

[22] Filed: Sep. 5, 1989

[51] Int. Cl.[5] ..... C07C 5/22

[52] U.S. Cl. ..... 585/255; 585/518; 585/530; 585/739; 585/740; 585/741; 585/747

[58] Field of Search ..... 585/253, 255, 518, 530, 585/739, 740, 741, 747

[56] References Cited

U.S. PATENT DOCUMENTS

| | | | |
|---|---|---|---|
| 4,827,064 | 5/1989 | Wu | 585/10 |
| 4,827,073 | 5/1989 | Wu | 585/530 |
| 4,851,109 | 7/1989 | Chen et al. | 585/739 |
| 4,855,530 | 8/1989 | LaPierre et al. | 585/739 |
| 4,877,581 | 10/1989 | Chen et al. | 585/739 |
| 4,914,254 | 4/1990 | Pelrine | 585/530 |

*Primary Examiner*—Curtis R. Davis

*Attorney, Agent, or Firm*—Alexander J. McKillop; Charles J. Speciale; Malcolm D. Keen

[57] ABSTRACT

A process is disclosed for improving the thermal stability of polyalpha-olefin lubricants by contacting the lubricant with an acidic catalyst for a time and at a temperature sufficient to achieve the skeletal isomerization of the molecular structure of the lubricant. The reaction is carried out preferably on unhydrogenated synthetic lubricants in contact with Lewis acid catalysts. Following the isomerization reaction, the unsaturated lubricant is hydrogenated to produce lubricant with better thermal stability. Surprisingly, when the isomerization reaction is carried out using unsaturated oligomer produced from the oligomerization of alpha-olefins in contact with reduced Group VIB metal oxide catalyst on porous support as starting material the viscometric properties of the lubricant, e.g., viscosity and VI, are not significantly altered, although the thermal stability of the lubricant is substantially increased. The reaction of the present invention may be carried out in the presence of a solvent or neat. Improvements in thermal stability are observed over a wide range of catalyst concentration. Concentrations of about 10 weight percent are preferred with aluminum chloride catalyst.

22 Claims, 4 Drawing Sheets

SKELETAL ISOMERIZATION OF HVI-PAO REACTION SCHEME

PROCESS FOR IMPROVING THERMAL STABILITY OF SYNTHETIC LUBES

This invention relates to a process for improving the thermal and oxidative stability of polyalpha-olefin synthetic lubricants. More particularly, the invention relates to a process for improving the thermal stability of high viscosity index (VI) PAO lubricants by treating the lubricants with catalytic amounts of acids under isomerization reaction conditions. The invention specifically applies to the acid treatment of unsaturated lubricant oligomers prepared by the oligomerization of 1-alkenes in contact with reduced Group VIB metal catalyst on solid support.

BACKGROUND OF THE INVENTION

The oligomerization of 1-alkenes by acid or Ziegler-Natta catalysis to produce polyalpha-olefin (PAO) synthetic lubricants with superior properties is well known in the art. PAO lubricants are notable in particular for their superior VI and low temperature properties compared to mineral oil based lubes. One characteristic of the molecular structure of 1-alkene oligomers that has been found to correlate very well with improved lubricant properties in commercial synthetic lubricants is the ratio of methyl to methylene groups in the oligomer. The ratio is called the branch ratio and is calculated from infra red data as discussed in "Standard Hydrocarbons of High Molecular Weight", Analytical Chemistry, Vol.25, no. 10, p. 1466 (1953). Viscosity index has been found to increase with lower branch ratio.

Recently, novel lubricant compositions (referred to herein as HVI-PAO) comprising polyalpha-olefins and methods for their preparation employing as catalyst reduced chromium on a silica support have been disclosed in U.S. Pat. applications Ser. No. 210,434 , now U.S. Pat. No. 4,827,073 and 210,435 , now U.S. Pat. No. 4,827,064, both filed June 23, 1988, incorporated herein by reference in their entirety. The HVI-PAO lubricants are made by a process which comprises contacting $C_6$–$C_{20}$ 1-alkene feedstock with reduced valence state chromium oxide catalyst on porous silica support under oligomerizing conditions in an oligomerization zone whereby high viscosity, high VI liquid hydrocarbon lubricant is produced having branch ratios less than 0.19 and pour point below −15° C. The process is distinctive in that little isomerization of the olefinic bond occurs compared to known oligomerization methods to produce polyalpha-olefins using acidic catalyst. Lubricants produced by the process cover the full range of lubricant viscosities and exhibit a remarkably high viscosity index (VI) and low pour point even at high viscosity. The as-synthesized HVI-PAO oligomer has a significant portion of terminal olefinic unsaturation. Typically, the HVI-PAO oligomer is hydrogenated to improve stability for lubricant applications.

Modifications to HVI-PAO oligomers or to prior art PAO synthetic lubes that result in improved thermal stability are particularly sought after as long as those modifications do not result in degradation of other properties such as VI. High VI allows the use of PAO lube stock at high temperature. However, at high temperatures PAO lubricants can break down and lose viscosity. Furthermore, when the lube molecules break down in the presence of oxygen the radical fragments can either combine with each other or react with oxygen to form organic acids and other polar compounds.

The result is increased sludge formation and unwanted viscosity increase.

It is an object of the present invention to provide a process for the production of PAO and HVI-PAO lubricants with enhanced thermal stability.

It is another object of the present invention is to provide a process for the production of thermally stable HVI-PAO by structural modification of the HVI-PAO oligomer molecule.

Yet another object of the present invention is to provide a process for the production of thermally and oxidatively stable HVI-PAO by treatment of the HVI-PAO lubricant oligomer with isomerizing agents without significantly degrading the viscometric properties of the lubricant.

SUMMARY OF THE INVENTION

It has been discovered that the thermal stability of polyalpha-olefin lubricants is significantly increased by contacting the lubricant with an acidic catalyst for a time and at a temperature sufficient to achieve the skeletal isomerization of the molecular structure of the lubricant. The reaction is carried out preferably on unhydrogenated lubricants in contact with acidic catalysts. Following the isomerization reaction, the unsaturated lubricant is hydrogenated to produce lubricant with better thermal stability. While unhydrogenated lubricant is the preferred starting material, hydrogenated lubricant can also be employed as starting material for the isomerization reaction; in which case further hydrogenation to produce lubricant with improved thermal stability is unnecessary.

Most unexpectedly, when the isomerization reaction is carried out using unsaturated HVI-PAO as starting material the viscometric properties of the lubricant, e.g., viscosity and VI, are not significantly altered, although the thermal stability of the HVI-PAO lubricant is substantially increased. This finding is particularly surprising in view of the fact that the lubricant product of the isomerization reaction contains a net increase of methyl groups in the structure, as determined by C-13 NMR. According to prevailing theories, such an increase would be expected to degrade VI properties, but no such degradation is encountered in the present invention.

The reaction of the present invention may be carried out in the presence of a solvent or neat. Improvements in thermal stability are observed over a wide range of catalyst concentrations or weight ratio of lubricant starting material to catalyst. However, concentrations of about 0.1% to 10 weight percent are preferred with aluminum chloride catalyst.

More specifically, a process has been discovered for the production of hydrocarbon lubricant basestock having improved thermal stability which comprises contacting the lubricant basestock with acidic catalyst in an isomerization zone under isomerization conditions for a time and temperature sufficient to isomerize the basestock. The basestock comprises the saturated oligomerization product of $C_2$–$C_{20}$ alpha-olefins in contact with reduced Group VIB metal oxide catalyst on porous solid support under oligomerization conditions. Following the reaction the product is separated and recovered by means known in the art to provide a lubricant with improved thermal stability and high VI. Where the basestock or starting material comprises unsaturated oligomerization product, the product of the isomerization reaction is hydrogenated to provide thermally stable lubricant.

DETAILED DESCRIPTION OF THE INVENTION

Figure 1:
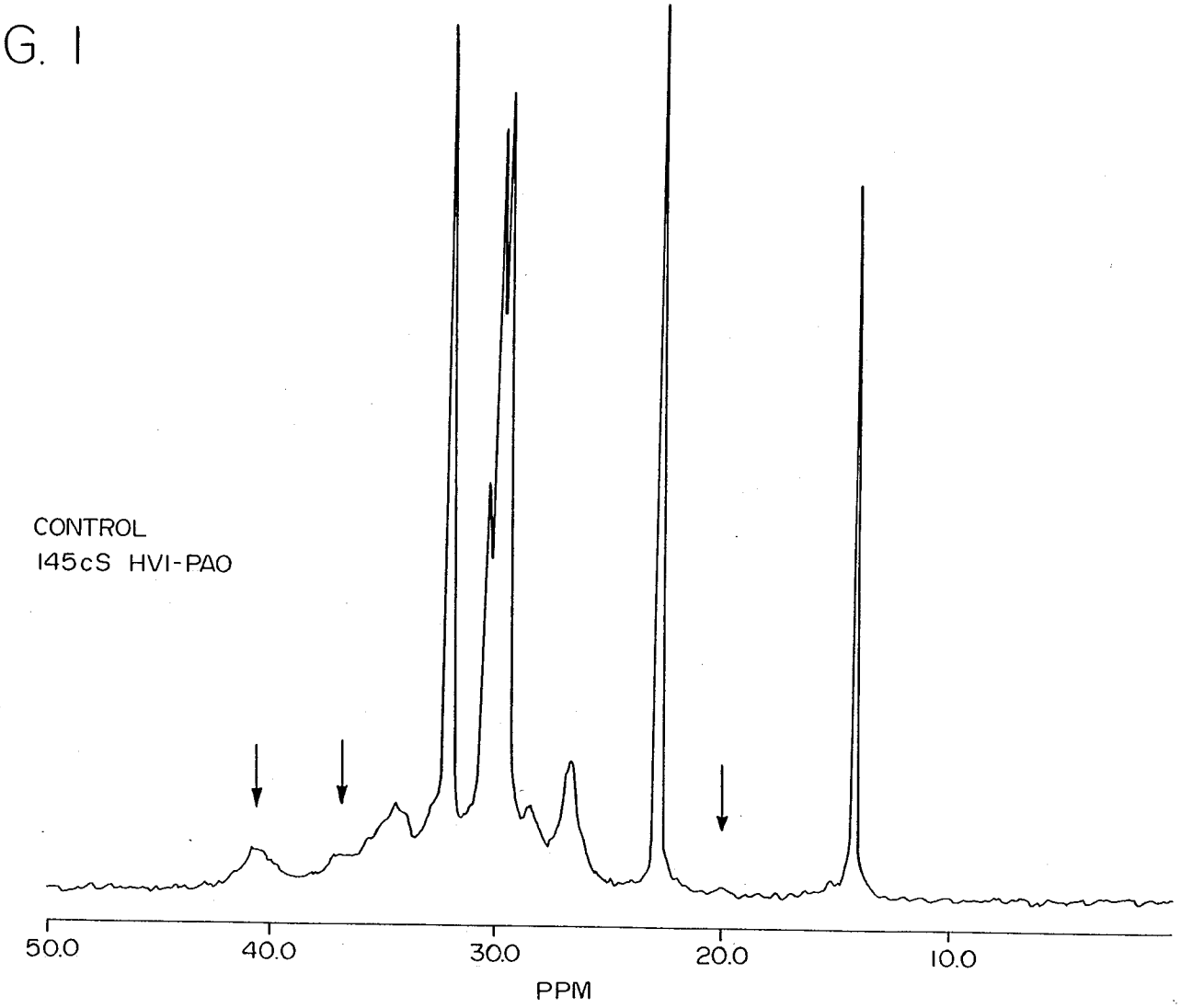
FIG. 1 is the C-13 NMR spectra for HVI-PAO starting material used in the present invention.

In the present invention, acids are reacted with unique olefin oligomers produced from the oligomerization of 1-alkenes in contact with reduced chromium oxide on silica support. As oligomerized, these HVI-PAO oligomers are mixtures of unsaturated hydrocarbons.

Polymerization of 1-alkenes with the novel reduced chromium catalyst described hereinafter leads to an oligomer substantially free of double bond isomerization. Conventional PAO, on the other hand, promoted by $BF_3$ or lCl3 forms a carbonium ion which, in turn, promotes isomerization of the olefinic bond and the formation of multiple isomers. The HVI-PAO produced in the present invention has a structure with a $CH_3/CH_2$ ratio $<0.19$ compared to a ratio of $>0.20$ for PAO.

HVI-PAO is distinctly superior to PAO in VI at all viscosities tested. Remarkably, despite the more regular structure of the HVI-PAO oligomers as shown by branch ratio that results in improved viscosity index (VI), they show pour points superior to PAO. It has been found that the process described herein to produce HVI-PAO oligomers can be controlled to yield oligomers having weight average molecular weight between 280 and 450,000 and number average molecular weight between 280 and 180,000. Measured in carbon numbers, molecular weights range from $C_{20}$ to $C_{13000}$ and viscosity up to 75OO cs at 100° C., with a preferred range of $C_{30}$ to $C_{10000}$ and a viscosity of up to 1000 cs at 100° C. for lube base stock material. Molecular weight distributions (MWD), defined as the ratio of weight average molecular to number average molecular weight, range from 1.00 to 5, with a preferred range of 1.01 to 3 and a more preferred MWD of about 1.05 to 2.5. Viscosities of the olefinic HVI-PAO oligomers used in the isomerization reaction of the present invention measured at 100° C. range from 1.5 cS to 7500 cS.

Olefins suitable for use as starting material in the preparation of olefinic HVI-PAO oligomers useful as starting material in the present invention include those olefins containing from 2 to about 20 carbon atoms such as ethylene, propylene, 1-butene, 1-pentene, 1-hexene, 1-octene, 1-decene, 1-dodecene and 1-tetradecene and branched chain isomers such as 4-methyl-1-pentene. Also suitable for use are olefin-containing refinery feedstocks or effluents. However, the olefins used in this invention are preferably alpha olefinic as for example 1-hexene to 1-hexadecene and more preferably 1-octene to 1-tetradecene, or mixtures of such olefins.

HVI-PAO oligomers of preferred alpha-olefins used in this invention have a low branch ratio of less than 0.19 and superior lubricating properties compared to the alpha-olefin oligomers with a high branch ratio, as produced in all known commercial methods.

This class of unsaturated HVI-PAO alpha-olefin oligomers are prepared by oligomerization of alpha-olefin by supported metal oxide catalysts, such as Cr compounds on silica or other supported IUPAC Periodic Table Group VIB compounds. The catalyst most preferred is a lower valence Group VIB metal oxide on an inert support. Preferred supports include silica, alumina, titania, silica alumina, magnesia aluminum phosphate and the like. The support material binds the metal oxide catalyst. Those porous substrates having a pore opening of at least 40 angstroms are preferred.

The support material usually has high surface area and large pore volumes with average pore size of 40 to about 350 angstroms. The high surface area are beneficial for supporting large amount of highly dispersive, active chromium metal centers and to give maximum efficiency of metal usage, resulting in very high activity catalyst. The support should have large average pore openings of at least 40 angstroms, with an average pore opening of $>60$ to 300 angstroms preferred.

The supported metal oxide catalysts are preferably prepared by impregnating metal salts in water or organic solvents onto the support. Any suitable organic solvent known to the art may be used, for example, ethanol, methanol, or acetic acid. The solid catalyst precursor is then dried and calcined at 200 to 900° C. by air or other oxygen-containing gas. Thereafter the catalyst is reduced by any of several various and well known reducing agents such as, for example, CO, $H_2$, $NH_3$, $H_2S$, $CS_2$, $CH_3SSCH_3$, metal alkyl containing compounds such as $R_3Al$, $R_3B$,$R_2Mg$, RLi, $R_2Zn$, where R is alkyl, alkoxy, aryl and the like. Preferred are CO or $H_2$ or metal alkyl containing compounds. Alternatively, the Group VIB metal may be applied to the substrate in reduced form, such as $Cr^{+2}$ compounds. The resultant catalyst is very active for oligomerizing olefins at a temperature range from below room temperature to about 250° C., preferably 90–250° C., at a pressure of 0.1 atmosphere to 5000 psi. Contact time of both the olefic and the catalyst can vary from one second to 24 hours. The catalyst can be used in a batch type reactor or in a fixed bed, continuous-flow reactor. The weight ratio of feedstock to catalyst can be between 1000:1 and 4:1.

In general the support material may be added to a solution of the metal compounds, e.g., acetates or nitrates, etc., and the mixture is then mixed and dried at room temperature. The dry solid gel is purged at successively higher temperatures to about 600° for a period of about 16 to 20 hours. Thereafter the catalyst is cooled down under an inert atmosphere to a temperature of about 250 to 450° C. and a stream of pure reducing agent is contacted therewith for a period when enough CO has passed through to reduce the catalyst as indicated by a distinct color change from bright orange to pale blue. Typically, the catalyst is treated with an amount of CO equivalent to a two-fold stoichiometric excess to reduce the catalyst to a lower valence CrII state. Finally the catalyst is cooled down to room temperature and is ready for use.

The product oligomers have a very wide range of viscosities with high viscosity indices suitable for high performance lubrication use. These low branch ratio oligomers have high viscosity indices at least about 15 to 20 units and typically 30–40 units higher than equivalent viscosity prior art oligomers, which regularly have higher branch ratios and correspondingly lower viscosity indices. These low branch oligomers maintain better or comparable pour points.

The branch ratios are defined as the ratios of $CH_3$ groups to $CH_2$ groups in the lube oil and are calculated from the weight fractions of methyl groups obtained by infrared analytical methods as published in *Analytical Chemistry*, Vol. 25, No. 10, p. 1466 (1953).

$$\text{Branch ratio} = \frac{\text{wt fraction of methyl group}}{1 - (\text{wt fraction of methyl group})}$$

The following Examples illustrate the preparation of catalyst used in the preparation of HVI-PAO unsaturated oligomers as well as the oligomerization process used to prepare starting material for the process of the instant invention.

EXAMPLE 1

Catalyst Preparation and Activation Procedure 1.9 grams of chromium (II) acetate ($Cr_2(OCOCH_3)_4 2H_2O$) (5.58 mmole) (commercially obtained) is dissolved in 50 cc of hot acetic acid. Then 50 grams of a silica gel of 8–12 mesh size, a surface area of 300 $m^2/g$, and a pore volume of 1 cc/g, also is added. Most of the solution is absorbed by the silica gel. The final mixture is mixed for half an hour on a rotavap at room temperature and dried in an open-dish at room temperature. First, the dry solid (20 g) is purged with $N_2$ at 250° C. in a tube furnace. The furnace temperature is then raised to 400° C. for 2 hours. The temperature is then set at 600° C. with dry air purging for 16 hours. At this time the catalyst is cooled down under $N_2$ to a temperature of 300° C. Then a stream of pure CO (99.99% from Matheson) is introduced for one hour. Finally, the catalyst is cooled down to room temperature under $N_2$ and ready for use.

EXAMPLE 2

The catalyst prepared in Example 1 (3.2 g ) is packed in a ⅜ stainless steel tubular reactor inside an $N_2$ blanketed dry box. The reactor under $N_2$ atmosphere is then heated to 150° C. by a single-zone Lindberg furnace. Prepurified 1-hexene is pumped into the reactor at 140 psi and 20 cc/hr. The liquid effluent is collected and stripped of the unreacted starting material and the low boiling material at 0.05 mm Hg. The residual clear, colorless liquid has viscosities and VI's suitable as a lubricant base stock.

| Sample | Prerun | 1 | 2 | 3 |
|---|---|---|---|---|
| T.O.S., hr. | 2 | 3.5 | 5.5 | 21.5 |
| Lube Yield, wt % | 10 | 41 | 74 | 31 |
| Viscosity, cS, at | | | | |
| 40° C. | 208.5 | 123.3 | 104.4 | 166.2 |
| 100° C. | 26.1 | 17.1 | 14.5 | 20.4 |
| VI | 159 | 151 | 142 | 143 |

EXAMPLE 3

A commercial chrome/silica catalyst which contains 1% Cr on a large-pore volume synthetic silica gel is used. The catalyst is first calcined with air at 800° C. for 16 hours and reduced with CO at 300° C. for 1.5 hours. Then 3.5 g of the catalyst is packed into a tubular reactor and heated to 100° C. under the $N_2$ atmosphere. 1-Hexene is pumped through at 28 cc per hour at 1 atmosphere. The products are collected and analyzed as follows:

| Sample | C | D | E | F |
|---|---|---|---|---|
| T.O.S., hrs. | 3.5 | 4.5 | 6.5 | 22.5 |
| Lube Yield, % | 73 | 64 | 59 | 21 |
| Viscosity, cS, at | | | | |
| 40° C. | 2548 | 2429 | 3315 | 9031 |
| 100° C. | 102 | 151 | 197 | 437 |
| VI | 108 | 164 | 174 | 199 |

These runs show that different Cr on a silica catalyst are also effective for oligomerizing olefins to lube products.

EXAMPLE 4

1.0 part by weight of the activated catalyst prepared as in Example 3 is added to 1-decene of 200 parts by weight in a suitable reactor and heated to 125 ° C. 1-Decene is continuously fed to the reactor at 2–3.5 parts/minute and 0.5 parts by weight of catalyst is added for every 100 parts of 1-decene feed. After 1200 parts of 1-decene and 6 parts of catalyst are charged, the slurry is stirred for 8 hours. The catalyst is filtered and light product boiled below 150 ° C. @ 0.1 mm Hg is stripped. The finished product has a viscosity at 100 ° C. of 145 cs, VI of 214 and pour point of −40° C.

The modified HVI-PAO lubricants of the present invention are prepared in an acid catalyzed reaction conducted under isomerization conditions. The reaction is referred to herein as an isomerization reaction and the reaction conditions as isomerization conditions. However, this characterization is not intended to preclude the possibility of other reactions occurring under the conditions described herein as isomerization conditions. Other reactions can include polymerization, alkylation or dealkylation and, in general, those reactions initiated by carbonium ion formation accomplished by acid catalysis. Nevertheless, isomerization and rearrangement of HVI-PAO is achieved herein under the conditions described and the term isomerization is intended to apply to all the reactions ongoing under the condition described.

Acids which may be used as catalyst in the present invention include Lewis acids such as, but not limited to, $BF_3$ and complexes thereof, $AlCl_3$, HCl, HF, HBr, $H_2SO_4$, $H_3PO_4$, $P_2O_5$, $SO_3$, $SnCl_4$, $FeCl_3$, $ZnCl_2$, $TiCl_4$, $SbCl_5$, acidic zeolites, acidic clay catalysts or amorphous aluminosilicates, particularly zeolite such as H-ZSM-5, H-ZSM-12, HY and organic acids such as R—$SO_3H$ where R is a polymeric resin such as sulfonated polystyrene. Preferred catalysts are $AlCl_3$, $BF_3$, acidic zeolites such as Zeolite Beta, Zeolite Y, ZSM-5, ZSM-35, ZSM-12 and Amberlyst 15, obtainable from Rohm & Haas.

It has been found that the amount of catalyst used in the present invention can vary over a wide range, based on the amount of HVI-PAO. The amount of catalyst used has a definite effect upon the degree of increased thermal stability conferred upon the HVI-PAO. While the use of low quantities of catalysts, i.e., less than 3 wt.% based upon HVI-PAO, results in increased thermal stability, substantial increases in thermal stability are achieved when quantities of acid of about 10 wt.% are used. In practicing the instant invention, weight ratios of HVI-PAO to acid ranging from about 500:1 to 4:1 can be used with a preferred ratio of 10:1.

The isomerization process may be carried out in the presence of a solvent or neat. Solvents which may be used are preferably those that are inert under conditions of the reaction. Hydrocarbon solvents can be effectively employed in particular, $C_6$–$C_{12}$ aliphatic hydrocarbon solvents. The process may be conducted in a reaction or isomerization zone comprising a fixed bed catalytic reactor, a continuous stirred tank reactor, or an unstirred reactor. The reaction temperature can be between −10° C. and 350° C. More preferably the reaction temperature is between about 20° C. and 200° C. with the most preferred reaction temperature being about 50° C. to 100° C., depending on catalyst used.

The HVI-PAO oligomer which is treated in the process of the instant invention to increase its thermal and oxidative stability can be any of the HVI-PAO oligomers produced by the processes described in the previously referenced patent application. These include oligomers having a viscosity measured at 100° C. between about 1.5 cS and 7500 cS. As noted herein before, the oligomers produced by the HVI-PAO process is unsaturated and this unsaturated oligomer can be used as starting material. Following the isomerization step carried out on the unsaturated oligomer the product is hydrogenated to produce the more thermally stable lubricant. Hydrogenation can be carried out by a variety of methods known to those skilled in the art such as hydrogenation with hydrogen using nickel on kieselguhr catalyst. Alternatively, the unsaturated oligomer produced by the HVI-PAO process can be hydrogenated before isomerization according to the process of the instant invention and the isomerization reaction carried out on saturated HVI-PAO oligomer. However, it is preferred to carry out the isomerization process using unsaturated HVI-PAO oligomer.

In Example 5, the process of the instant invention is described for the isomerization of unhydrogenated HVI-PAO prepared according to Example 4.

EXAMPLE 5

A mixture of 50 gms. of the unhydrogenated HVI-PAO (Example 4) is mixed in three separate experiments (ex.5.1, 5.2, 5.3) with aluminum chloride ranging from 1.25 to 5.0 gms. in 200 ml. of heptane and heated to 60° C. for twenty-four hours. The reaction is quenched with water and the organic layer is separated and washed with 5% HCl twice. The material is then hydrogenated at 80° C. under 300 psi of hydrogen for six hours with nickel on kieselguhr as catalyst. The reaction conditions and properties of the product produced are listed in Table 1. The isomerized product at all levels of catalyst used surprisingly retain high viscosity and VI.

TABLE 1

| Product | % $AlCl_3$ used | Vis @ 100° C., cS | VI | Pour Pt °C. |
|---|---|---|---|---|
| Control | 0.0 | 145.0 | 212 | −30 |
| Ex. 5.1 | 2.5 | 190.1 | 211 | −37 |
| Ex. 5.2 | 5.0 | 146.8 | 202 | — |
| Ex. 5.3 | 10.0 | 144.0 | 199 | — |

EXAMPLE 6

The thermal stabilities of the products produced in Example 5 are examined by measuring the viscosity loss after heating to 280° C. and 300° C. for twenty-four hours under inert atmosphere. Samples each weighing approximately 5 grams are first degassed at 60° C. under vacuum for two hours and then heated to 280 and 300° C. under static nitrogen for twenty-four hours. The viscosities of these thermally treated products are measured and compared to the control material. The results are presented in Table 2.

TABLE 2

| Product | % Viscosity (100° C.) loss at 280° C. | 300° C. |
|---|---|---|
| HVI-PAO control | 65.1 | 76.0 |
| Ex. 5.1 | 30.8 | 80.4 |
| Ex. 5.2 | 19.8 | 64.2 |
| Ex. 5.3 | 16.3 | 51.1 |

As shown in Table 2, the products produced by the isomerization process of the instant invention are more thermally stable than the control, untreated HVI-PAO at all levels of HVI-PAO to catalyst weight ratios tested. The increase in thermal stability is particularly apparent when the process is run at catalyst concentrations of about 10 wt%. At all concentrations of catalyst used the product retains the favorable viscometric properties of the HVI-PAO starting material while demonstrating improved thermal stability.

In the present invention the extent of isomerization can partly be quantified by branch ratio. Using Infra-red spectroscopy, an increase of 2–5% in branch ratio from the control is observed for the isomerized products, as shown in Table 3.

TABLE 3

| Product | Uncalibrated Branch Ratio* | % increase |
|---|---|---|
| Control | 0.308 | 0 |
| Ex. 5.1 | 0.315 | 2.3 |
| Ex. 5.3 | 0.322 | 4.5 |

*The branch ratio reported for control under calibrated condition is 0.19.

The skeletal rearrangement which is thought to occur in the present invention involves an increase in the branching, or chain branching, of the starting material with the formation of methyl side groups as presented in Table 3. As a result of this, an increase in the branch ratio from calibrated values under 0.19 typical of the HVI-PAO starting material to higher values is observed. The increase in branch ratio is usually not more than 10% and normally is in the range of from 2 to 5%.

Figure 2:
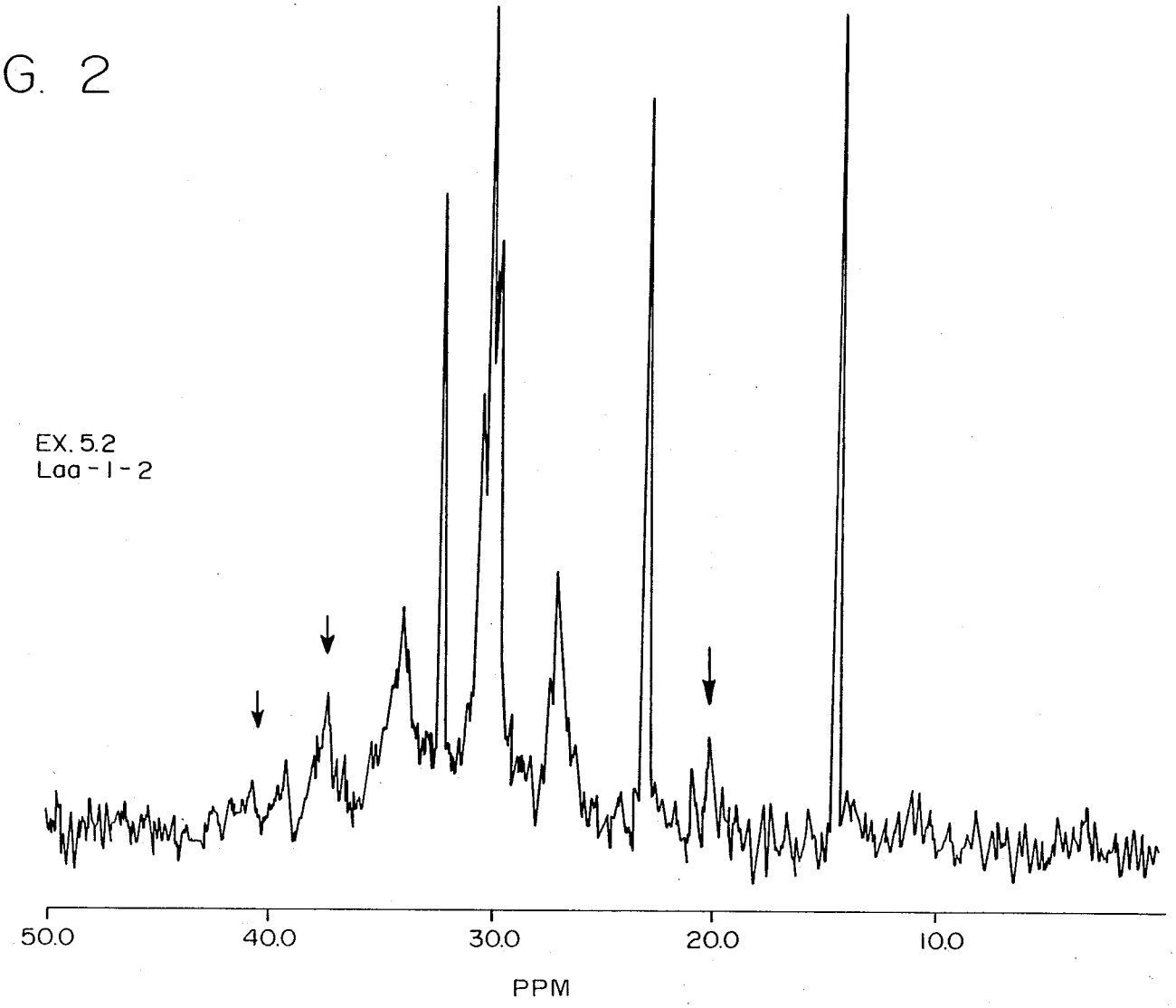
FIG. 2 is the C-13 NMR spectra of Example 5.2 product of isomerization of HVI-PAO according to the present invention.
Figure 3:
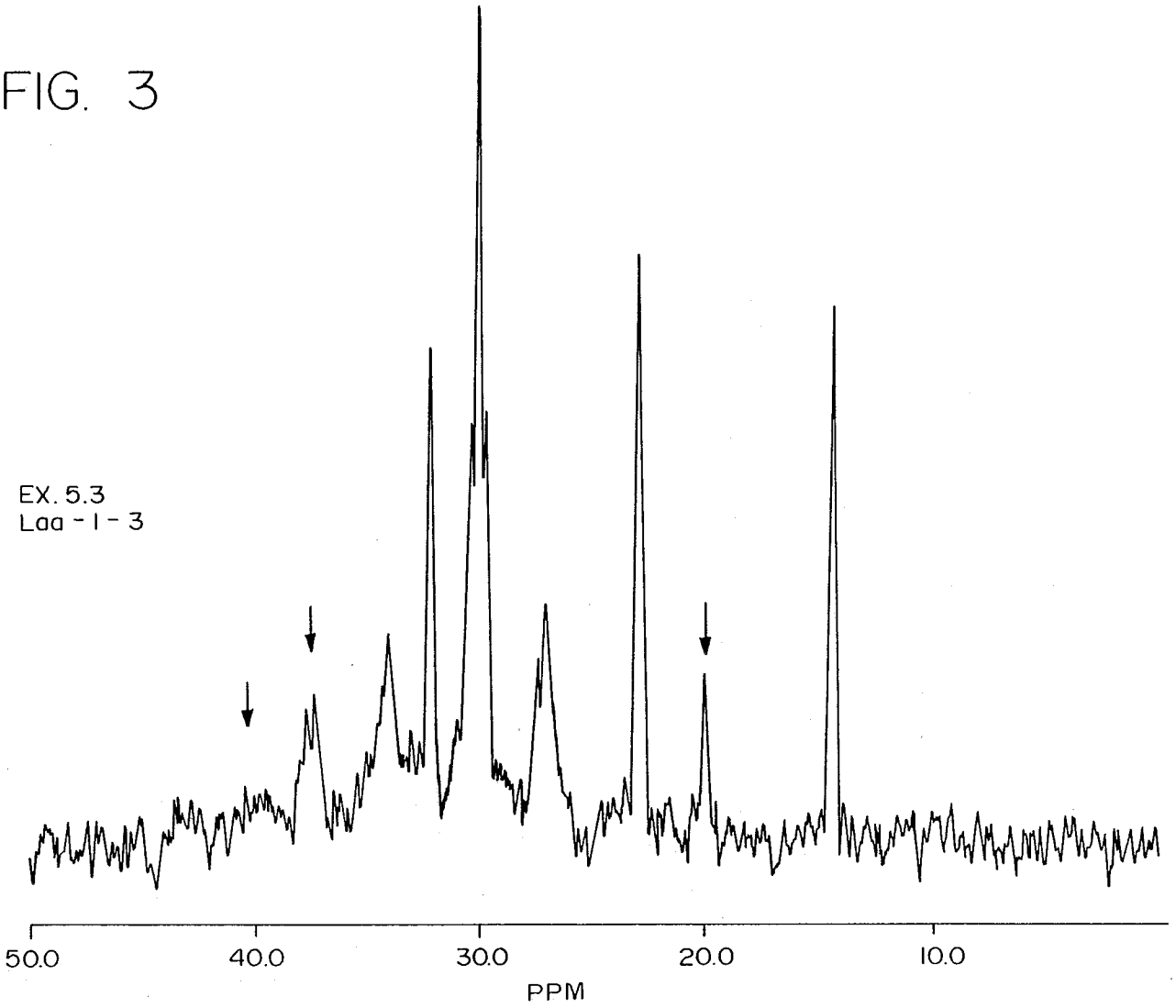
FIG. 3 is the C-13 NMR spectra of Example 5.3 product of isomerization of HVI-PAO according to the present invention.

The evidence for the skeletal isomerization of HVI-PAO in the presence of $AlCl_3$ as carried out in the present invention is obtained by comparative analysis of the C-13 NMR spectra of the starting material HVI-PAO and isomerized product. FIGS. 1–3 provide illustrations of such spectra for the starting material HVI-PAO and the product from Examples 5.2 and 5.3. Two major differences are observed between the spectra of the control and the products. In the spectra of the products, additional resonances appear at 20 ppm and resonances at 40 ppm shift upfield to 37.5 ppm. The resonance at the 20 ppm is typical of isolated methyl groups on linear carbon chains suggesting branching occurring on the side chain of the HVI-PAO.

Figure 4:
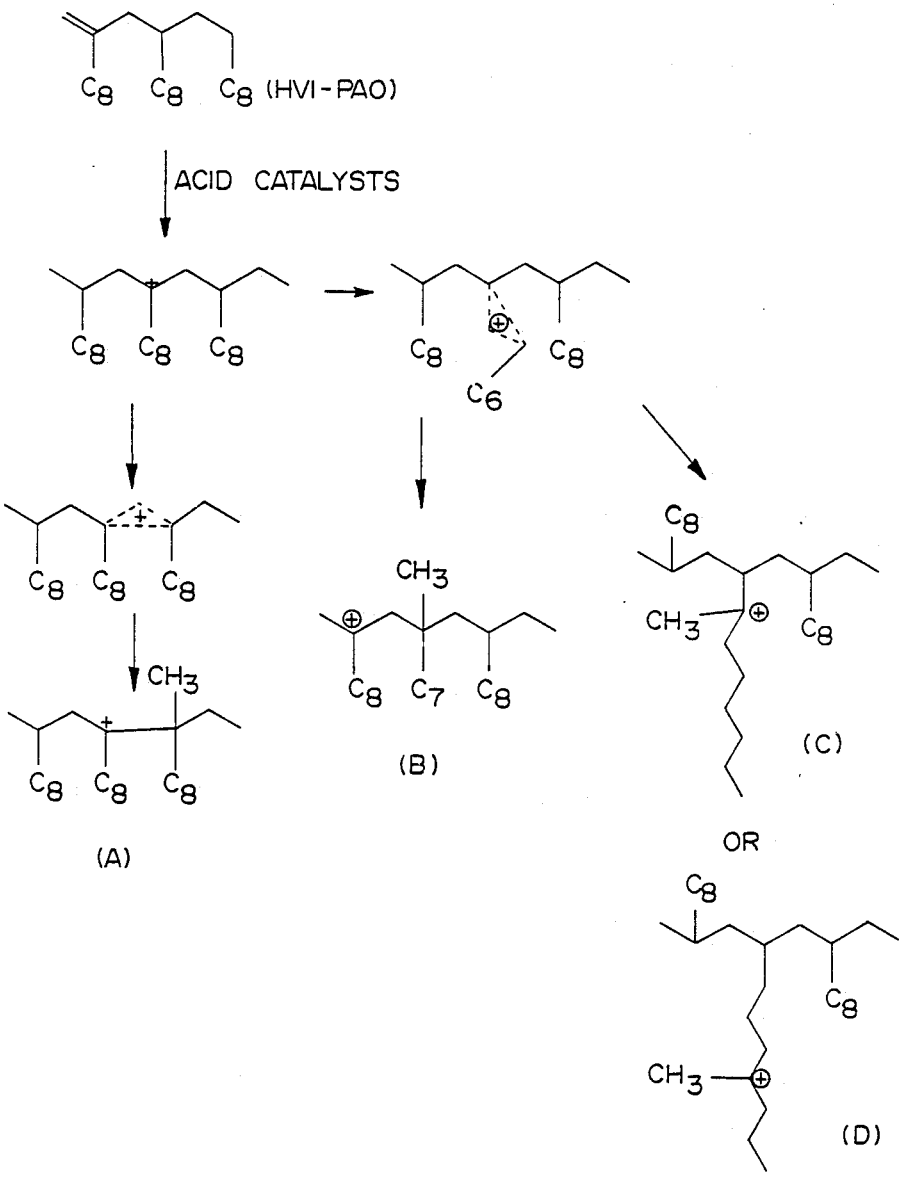
FIG. 4 is an illustration of the proposed reaction mechanism of the isomerization of the present invention.

Referring to FIG. 4, an illustration is presented of the theoretical reaction mechanism for the isomerization of HVI-PAO carried out in the present invention. In contact with acid, a carbonium ion is formed at the tertiary carbon atom of the backbone of HVI-PAO starting material. The reaction mechanism illustrates a rearrangement to form structures C and D with methyl branching occurring in the alkyl side chain of the starting material. The illustration further shows rearrangement occuring to produce structures A and B wherein methyl branching takes place on the backbone of the HVI-PAO. The upward shift noted in C-13 NMR resonances of the backbone methylene carbon results from the extra branching at the backbone of HVI-PAO, as shown in structure A and B in the mechanism illustrated.

Although the present invention has been described with preferred embodiments and examples, modifications and variations may be resorted to without departing from the spirit and scope of this invention. Such modifications and variations are considered to be within the purview and scope of the appended claims.

What is claimed is:

1. A process for the production of hydrocarbon lubricant basestock having improved thermal stability, comprising;

contacting said lubricant basestock with acidic catalyst in an isomerization zone under isomerization conditions for a time sufficient to isomerize said basestock, said basestock comprising the saturated oligomerization product of $C_2$–$C_{20}$ alpha-olefins in contact with reduced Group VIB metal oxide catalyst on porous solid support under oligomerization conditions; and separating and recovering isomerized basestock having improved thermal stability.

2. The process of claim 1 wherein said oligomerization product comprises unsaturated oligomerization product; and further comprising hydrogenating isomerization product of said unsaturated oligomerization product.

3. The process of claim 1 wherein said metal oxide catalyst comprises a chromium catalyst on a porous support, which catalyst has been treated by oxidation at a temperature of 200 C to 900 C. in the presence of an oxidizing gas and then by treatment with a reducing agent at a temperature and for a time sufficient to reduce said catalyst to a lower valence state.

4. The process of claim 1 further comprising contacting said lubricant basestock with acidic catalyst in an isomerization zone containing hydrocarbon solvent under isomerization conditions.

5. The process of claim 1 wherein said acidic catalyst comprises Lewis acid.

6. The process of claim 1 wherein said acidic catalyst is taken from the group consisting essentially of HF, $AlCl_3$, $BF_3$ and $BF_3$ complexes, $SbCl_5$, $SnCl_4$, $TiCl_4$, $P_2O_5$, $H_2SO_4$, $ZnCl_2$, acidic zeolites, sulfonated resins and acidic clays.

7. The process of claim 1 wherein said acidic catalyst is preferably aluminum chloride.

8. The process of claim 1 wherein said isomerization conditions comprise temperature between about −10° C. and 350° C.

9. The process of claim 1 wherein said isomerization conditions comprise temperature of about 20–200° C.

10. A process for the production of liquid hydrocarbon lubricant basestock having improved thermal stability and high VI, comprising;

contacting $C_6$ to $C_{20}$ alpha-olefin feedstock, or mixtures thereof, under oligomerization conditions in contact with a reduced valence state Group VIB metal catalyst on porous support, whereby unsaturated oligomer having a branch ratio less than 0.19 and viscosity index greater than 130 is produced;

separating said oligomer and contacting said oligomer with acidic catalyst in an isomerization zone under isomerization conditions for a time sufficient to isomerize said oligomer; and separating and hydrogenating said isomerization product to produce said liquid hydrocarbon lubricant basestock.

11. The process of claim 10 wherein said oligomerization conditions comprise temperature between 90–250° C. and feedstock to catalyst weight ratio between 1000:1 and 4:1; said catalyst comprises CO reduced $CrO_3$ and said support comprises silica having a pore size of at least 40 Angstroms.

12. The process of claim 10 wherein said acidic catalyst is taken from the group consisting essentially of HF, $AlCl_3$, $BF_3$ and $BF_3$ complexes, $SbCl_5$, $SnCl_4$, $TiCl_4$, $P_2O_5$, $H_2SO_4$, $ZnCl_2$, acidic zeolites, sulfonated resins and acidic clays.

13. The process of claim 10 wherein said acidic catalyst is preferably aluminum chloride.

14. The process of claim 10 wherein said isomerization conditions comprise temperature between about −10° C. and 350° C.

15. The process of claim 10 wherein said isomerization conditions comprise temperature of about 20–200° C.

16. The process of claim 2 or 10 wherein said isomerization product is hydrogenated with hydrogen in contact with nickel on kieselguhr catalyst.

17. The process of claim 1 wherein the weight ratio of said lubricant basestock to said catalyst is between 500:1 and 4:1.

18. The process of claim 1 wherein the weight ratio of said lubricant basestock to said catalyst is preferably 10:1.

19. The process of claim 10 wherein said isomerized oligomer has a branch ratio not more than 10% greater than unisomerized oligomer starting material.

20. The process of claim 19 wherein, said isomerized oligomer branch ratio is between 2 and 5 percent greater than said unisomerized oligomer.

21. The process of claim 10 whereby liquid hydrocarbon lubricant basestock is produced having an increase in chain branching and viscosity index of at least 130, measured at 100° C.

22. The process of claim 21 wherein said increase in chain branching comprises increased methyl group branches.

* * * * *